US007124556B2

(12) United States Patent
Noumi

(10) Patent No.: US 7,124,556 B2
(45) Date of Patent: Oct. 24, 2006

(54) DEVICE FOR BAGGING DRY INGREDIENTS

(76) Inventor: Kenji Noumi, 6-12, Gion 4-chome, Yahatahigashi-ku, Kitakyushu-shi, Fukuoka 805-0067 (JP)

( * ) Notice: Subject to any disclaimer, the term of this patent is extended or adjusted under 35 U.S.C. 154(b) by 29 days.

(21) Appl. No.: 10/511,167

(22) PCT Filed: Apr. 14, 2003

(86) PCT No.: PCT/JP03/04735

§ 371 (c)(1),
(2), (4) Date: Oct. 14, 2004

(87) PCT Pub. No.: WO03/086868

PCT Pub. Date: Oct. 23, 2003

(65) Prior Publication Data

US 2005/0115210 A1 Jun. 2, 2005

(30) Foreign Application Priority Data

Apr. 16, 2002 (JP) ..... 2002-151583

(51) Int. Cl.
*B65B 1/32* (2006.01)
*B65B 9/00* (2006.01)

(52) U.S. Cl. ..... 53/502; 53/545; 53/546; 53/547

(58) Field of Classification Search ..... 53/502, 53/545, 546, 547, 548, 134.2; 222/411, 412
See application file for complete search history.

(56) References Cited

U.S. PATENT DOCUMENTS

| | | | | | |
|---|---|---|---|---|---|
| 2,139,039 | A | * | 12/1938 | Salfisberg | 53/546 |
| 2,334,256 | A | * | 11/1943 | Eaton | 53/134.2 |
| 2,994,996 | A | * | 8/1961 | Klar | 53/134.2 |
| 3,383,269 | A | * | 5/1968 | Kopp | 53/546 |
| 4,090,344 | A | | 5/1978 | Kelly | 53/28 |
| 4,222,502 | A | * | 9/1980 | Gubitose et al. | 222/411 |
| 4,632,009 | A | * | 12/1986 | Dann | 222/161 |
| 4,706,439 | A | * | 11/1987 | Barton | 53/546 |
| 5,235,794 | A | * | 8/1993 | Center | 53/546 |
| 5,460,844 | A | * | 10/1995 | Gaylor | 53/134.2 |
| 5,737,904 | A | * | 4/1998 | Simionato | 53/502 |

FOREIGN PATENT DOCUMENTS

| | | | |
|---|---|---|---|
| JP | 54-150290 | | 11/1979 |
| JP | 8-62029 | | 3/1996 |
| JP | 8-226845 | * | 9/1996 |
| JP | 10-318824 | | 12/1998 |
| JP | 11-132835 | | 5/1999 |
| JP | 2000-5875 | | 1/2000 |
| JP | 2001-124619 | | 5/2001 |

(Continued)

*Primary Examiner*—Louis Huynh
(74) *Attorney, Agent, or Firm*—Westerman, Hattori, Daniels & Adrian, LLP.

(57) ABSTRACT

A device 10 for bagging dry ingredients, wherein a packaging mechanism 16 is integrally disposed under a weighing mechanism 13 for stored dry ingredients 12 and through a common frame 18. The weighing mechanism 13 comprises a plurality of juxtaposed dispensing pipes 22–25 for dispensing the dry ingredients 12 in a hopper 21, and weighing buckets 27–30 having an open/close dumper 26 for weighing the dispensed dry ingredients 12 and temporally storing them. The dry ingredients 12 in each of the weighing buckets 27–30 are discharged into a dispensing chute 31 through the open/close dumber 26 and are supplied at high speed to the packaging mechanism 16 immediately therebelow through the dispensing chute 31.

8 Claims, 6 Drawing Sheets

FOREIGN PATENT DOCUMENTS

| | | |
|---|---|---|
| JP | 2002-39846 | 2/2002 |
| JP | 2003-54736 | 2/2003 |
| JP | 2003-95201 | 4/2003 |
| JP | 2003-139603 | 5/2003 |
| JP | 2003-212322 | 7/2003 |
| JP | 2004-125760 | 4/2004 |
| WO | WO 00/73748 | 12/2000 |

* cited by examiner

DEVICE FOR BAGGING DRY INGREDIENTS

This application is a 371 of PCT/JP03/04735 filed Apr. 14, 2003 and claims priority to Japanese Application No. 200215183, filed Apr. 16, 2002.

TECHNICAL FIELD

The present invention relates to a device for bagging dry ingredients, operable to dispense and weigh a small amount of dry ingredients sequentially at high speed in a weighing mechanism, and to package the dispensed dry ingredients in a packaging mechanism. The dry ingredients include, e.g., toppings to put on cooked rice with hot green tea poured thereon, various fish and vegetable flakes to sprinkle on cooked rice, or condiments in packed ramen.

BACKGROUND ART

For example, when dry ingredients (i.e., powder articles such as toppings to put on cooked rice with hot green tea poured thereon, various fish and vegetable flakes to sprinkle on cooked rice, or condiments in packed ramen) put in a hopper are to be put into small bags, the dry ingredients are dispensed in small amounts sequentially in stages to pack a certain amount of them into the small bags. Mechanizing such a dry ingredient-bagging step requires a weighing mechanism operable to dispense the dry ingredients in certain amounts sequentially while weighing them, and a packaging mechanism operable to pack the dispensed dry ingredients from the weighing mechanism in sequence into the small bags.

One known type of a prior art weighing mechanism for sequentially dispensing the dry ingredients in small amounts is, e.g., a weighing mechanism comprising a plurality of multistage vibrating feeders serially connected in two-to-four stages, and load cell-equipped, weighing buckets. The multistage vibrating feeders are juxtaposed in several rows on the downstream side of a hopper having the dry ingredients held therein. The dry ingredients dispensed from each of the multistage vibrating feeders are weighed by corresponding one of the weighing buckets. A typical packaging mechanism for packaging the dispensed dry ingredients from the weighing mechanism is operated to package the dispensed dry ingredients sequentially into the small bags, while moving a small bag-forming packaging material in an either machine or cross-machine direction.

However, the prior art weighing mechanism employs vibrating feeders that contain individual vibration sources, and must avoid interference from the vibrating feeders. This requirement brings about a problem that the entire apparatus is increased in size. In addition, the prior art weighing mechanism must be provided with a special countermeasure to prevent weighing units such as load cells from being adversely affected by the vibration from the vibrating feeders. Nevertheless, the prior art weighing mechanism still has difficulties in accurately weighing the dry ingredients in small amounts.

Another difficulty is to combine the large-sized, vibration-causing weighing mechanism integrally with the packaging mechanism. Conventionally, the weighing and packaging mechanisms are supplied from different manufacturers, and are combined together on site or otherwise at an assembly plant in some cases. As a result, each time when the weighing and packaging mechanisms are incorporated into a bagging apparatus, these two different mechanisms must be modified to connect their separately designed mechanism to one another, and further to connect their separately designed control units to one another. The modification results in a rise in price of the apparatus, and both time and cost incurred by the modification are considerably increased.

In view of the above, objects of the present invention are to provide a downsized device for bagging dry ingredients, operable to weigh small amounts of dry ingredients accurately at high speed, and to simplify the entire device including its control unit.

DISCLOSURE OF INVENTION

To achieve the objects of the present invention, the present invention provides a device for bagging dry ingredients comprising a weighing mechanism operable to dispense and weigh stored dry ingredients, and a packaging mechanism operable to allow the dry ingredients in predetermined amounts sequentially dispensed by the weighing mechanism to be encapsulated in sequence into small bags that are formed continuously from a belt-like packaging material having a certain width. The packaging mechanism located below the weighing mechanism is integrated with the weighing mechanism on a common frame. The weighing mechanism comprises: a hopper operable to store the dry ingredients and to discharge the dry ingredients in steps out of the hopper through a bottom of the hopper; a plurality of juxtaposed dispensing pipes positioned horizontally or slanted downward in a direction in which the dry ingredients discharged from the hopper are dispensed, the dispensing pipes being driven into independent rotation, thereby dispensing the dry ingredients in steps from the hopper; weighing buckets positioned downward from the dispensing pipes, operable to weigh the dry ingredients to store them in predetermined amounts, each of the weighing buckets being provided with a pivotal, open/close damper at a lower portion of each of the weighing buckets in order to dispense the dry ingredients temporarily stored in the weighing buckets; and a dispensing chute operable to supply the packaging mechanism with the dry ingredients discharged from the weighing buckets. The dry ingredients in predetermined amounts stored in the weighing buckets are discharged from the weighing buckets into the dispensing chute through the open/close dampers, and the dry ingredients are fed in sequence into the packaging mechanism at elevated speed through the dispensing chute. The packaging mechanism is located beneath the dispensing chute. According to the above construction, the plurality of dispensing pipes and the plurality of weighing buckets are employed instead of prior art several vibrating feeders, thereby generating no vibration. The no vibration allows for rapid, accurate weighing of small amounts of the dry ingredient. The above construction provides the downsized device for bagging dry ingredients, and further integrates the weighing mechanism with the packaging mechanism on the common frame, thereby providing simplified mechanical and control units.

The present invention provides a device for bagging dry ingredients, in which the packaging mechanism can comprise: a packaging material-folding unit operable to progressively release the packaging material wound in a roll-shape, and to fold the packaging material into two equal parts along a centerline of the packaging material, the centerline being a center of a transverse direction of the packaging material; a small bag-forming unit operable to fabricate top-open, small bags by permitting the packaging material folded and supplied by the packaging material-folding unit to be longitudinally sealed along an open sideward edge of each of the small bags to be formed, and to be transversely sealed along a lower portion of each of the small bags to be formed, while simultaneously such transverse sealing allows each of the small bag already charged with the dry ingredients to be encapsulated along a top thereof; a small bag-conveying unit located downward from the small bag-forming unit for intermittently conveying the small bags downward; and a small bag-separating unit disposed downward from the small bag-conveying unit for allowing the small bags packed with the dry ingredients to be transversely cut off from each other in sequence along each position at which each of the small bags has transversely been sealed.

According to the above construction, in the packaging material-folding unit, the belt-like packaging material is folded into two equal parts along the centerline which is the center of the transverse direction of the packaging material, and the folded packaging material is fed into the small bag-forming unit. In the small bag-forming unit, the packaging material is longitudinally sealed, and transversely sealed along the lower portion of each of the small bags to be formed, thereby providing the top-open, small bags. The dry ingredients dispensed from the weighing mechanism are charged into each of the top-open small bags. The dry ingredient-charged small bags intermittently fed downward by the distance of one pitch by the small bag-conveying unit are transversely sealed along the top of each of the small bags. In the small bag-separating unit, the small bags packed with the dry ingredients are transversely cut off from each other in sequence along the transversely sealed portion of the each of the small bags.

The present invention provides a device for bagging dry ingredients, in which the dispensing chute can have a discharge port located over the small bag-forming unit, and the dry ingredients weighed by the weighing buckets can be put into the top-open, small bags through the discharge port immediately after the formation of the top-open, small bag. According to the above structure, the dry ingredients can be put promptly into the top-open, small bag through the dispensing chute.

The present invention provides a device for bagging dry ingredients, in which the hopper can comprise an upper hopper and a lower hopper located below the upper hopper, and a rotating dispenser can be provided on the upper hopper at a lower discharge portion of the upper hopper in order to feed the dry ingredients in steps from the upper hopper into the lower hopper through the dispenser. According to the above construction, great pressures dependent upon a head (a storage height in the lower hopper) are not applied to the dry ingredients to be introduced into the dispensing pipes. As a result, the dispensing pipes can stably dispense the dry ingredients.

The present invention provides a device for bagging dry ingredients, in which the plurality of dispensing pipes can be disposed on a common support member, and gradient angles of the plurality of dispensing pipes can be simultaneously adjustable. The above construction allows for simplified adjustment of the gradient angles of the dispensing pipes.

BEST MODE FOR CARRYING OUT THE INVENTION

For a more complete understanding of the present invention, an embodiment incorporating the present invention is now described with reference to the accompanying drawings.

Figure 1:
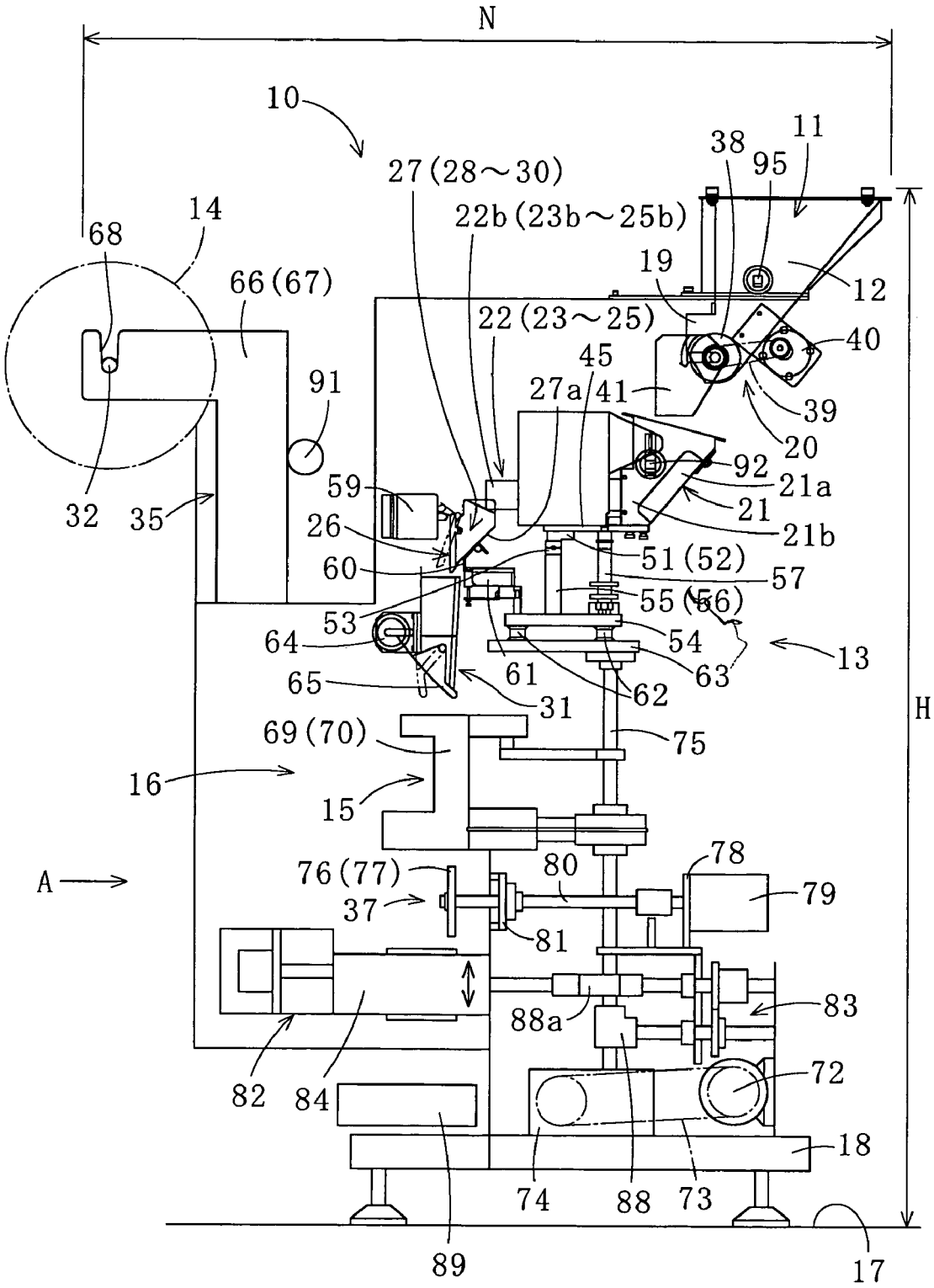
FIG. 1 is a cross-sectional front view illustrating a device for bagging dry ingredients according to an embodiment of the present invention, in which only essential components are illustrated for clarity.
Figure 2:
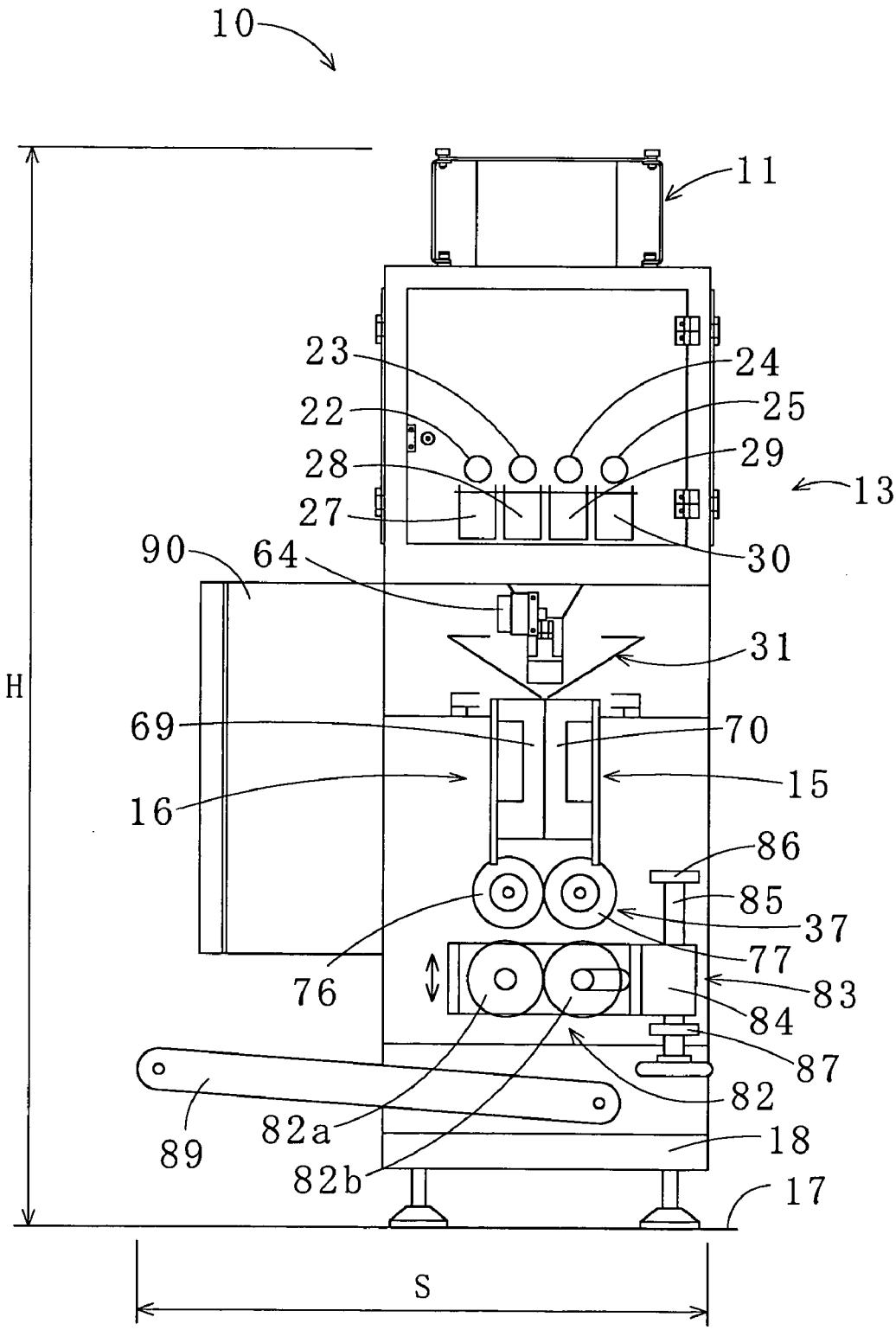
FIG. 2 is a partially cross-sectional side view illustrating the device for bagging the dry ingredient, in which only essential components are illustrated for clarity.
Figure 3:
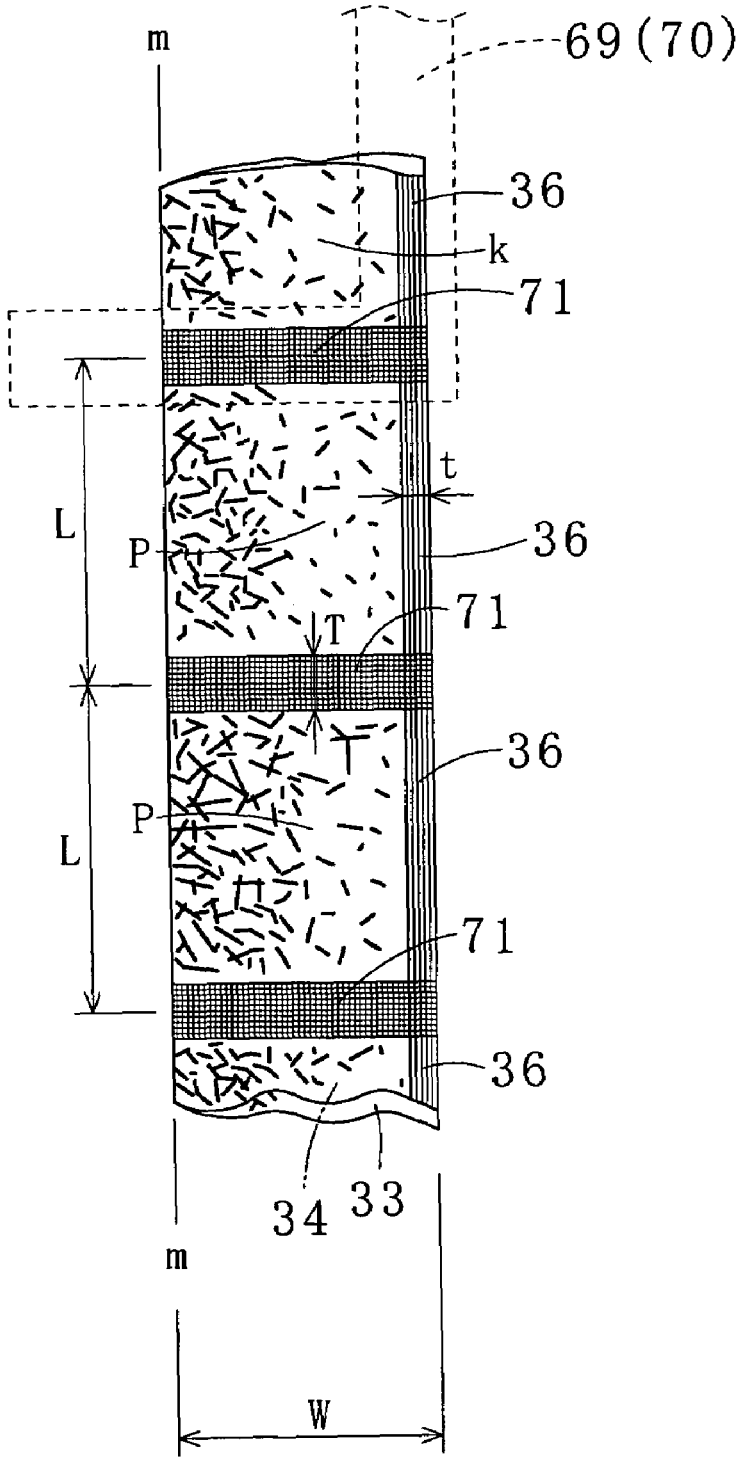
FIG. 3 is a descriptive illustration showing a large number of seriate small bags formed by a packaging mechanism in the device for bagging the dry ingredients.

As illustrated in FIGS. 1 to 3, a device 10 for bagging dry ingredients (hereinafter simply called a bagging device) according to the embodiment of the present invention includes a weighing mechanism 13 operable to permit dry ingredients 12 stored in an upper hopper 11 to be dispensed and weighed at high speed, and an upright, three-way sealing type of packaging mechanism 16 operable to allow the dry ingredients 12 in predetermined amounts sequentially dispensed at high speed from the weighing mechanism 13 to be charged in sequence into small bags "k's", and thereafter to seal each of the small bags "k's" along edges thereof. The small bags "k's" are continuously formed from a belt-like packaging material 14 having a certain width. The following discusses details of the above two mechanisms. In FIG. 1, arrow-designated visual line "A" reaches a side surface of the device 10 for bagging dry ingredients.

As illustrated in FIGS. 1 and 2, the weighing mechanism 13 of the bagging device 10, disposed on a common frame 18 that rests on a floor 17, includes the upper hopper 11 positioned via a supporting member (not shown), a rotating dispenser 20 provided in the upper hopper 11 at a lower discharge portion 19 thereof, and a lower hopper 21 located beneath the upper hopper 11. The rotating dispenser 20 is operable to discharge the stored dry ingredients 12 out of the upper hopper 11. The lower hopper 21 is operable to store the dispensed dry ingredients 12 from the dispenser 20.

As illustrated in FIGS. 1, 2, 4, 5, and 6, the weighing mechanism 13 of the bagging device 10 further includes a plurality of juxtaposed dispensing pipes (four dispensing pipes according to the present embodiment) 22–25 communicated with a discharge port of the lower hopper 21 and disposed at a downward slant in the direction in which the dry ingredients 12 are dispensed, weighing buckets 27–30 disposed downstream from the dispensing pipes 22–25, respectively, and a dispensing chute 31. The dispensing pipes 22–25 are independently driven into rotation, thereby stirring the dry ingredients 12 stored in the lower hopper 21 in the course thereof, dispensing the stirred dry ingredients 12 out of the lower hopper 21 in a downward-slanted direction. The weighing buckets 27–30 are operable to weigh the dry ingredients 12 to store only a predetermined amount of them. A rotating arm type of an open/close damper 26 is disposed on each of the weighing buckets 27–30 at a lower portion thereof for dispensing the temporarily stored dry ingredients 12 out of the weighing buckets 27–30. Each of the weighing buckets 27–30 includes a slanted bottom plate "27*a*" at the bottom thereof. The dispensing chute 31 is operable to rapidly feed the discharged dry ingredients 12 from the weighing buckets 27–30 into a small bag-forming unit 15 of the packaging mechanism 16.

As illustrated in FIGS. 1–3, the packaging mechanism 16 of the bagging device 10 includes a packaging material-folding unit 35, the small bag-forming unit 15, a small bag-conveying unit 37 positioned downstream from the small bag-forming unit 15, and a small bag-separating unit 82 located downstream from the small bag-conveying unit 37. The belt-like packaging material 14 wound around an unreeling roller 32 is released in stages from the unreeling roller 32. The packaging material-folding unit 35 is operable to fold the released packaging material 14 into two equal parts with along a centerline "m" to permit inner surfaces 33, 34 to be overlaid with one another, the centerline being a center of the transverse (sideward) direction of the packaging material 14. The small bag-forming unit 15 is operable to seal the folded packaging material 14 supplied by the packaging material-folding unit 35 in the longitudinal direction thereof along an open sideward edge 36 of the small bag to be formed, and in the transverse direction thereof along a lower portion of the small bag to be formed, thereby forming the top-open, small bag "k". At the same time, the transverse sealing allows the small bag "k" already charged with the dry ingredients 12 to be encapsulated along the top of the small bag "k". The small bag-conveying unit 37 is operable to intermittently feed the small bags "P's" downward. The small bag-separating unit 82 is operable to sequentially cut the dry ingredient-containing, sealed small bags "P's" in the transverse direction thereof along the transversely sealed portions of the small bags "P's", thereby cutting off them from each other.

The following discusses details of the weighing mechanism 13.

The upper hopper 11, made wholly of an either iron or stainless-steel raw material, has a rectangular shape when viewed from the top thereof, while having a horizontal cross-section downwardly reduced in size. The lower discharge portion 19 is provided at the lower end of the upper hopper 11. The rotating dispenser 20 is disposed at a discharge port of the lower discharge portion 19 of the upper hopper 11. The dispenser 20 includes a dispenser body 38 having a cross-shaped, rotating blade (not shown) mounted thereon, and a decelerator-equipped, electric motor 40 disposed outside the lower end of the upper hopper 11 for driving the dispenser body 38 into rotation through an endless chain 39. The decelerator-equipped, electric motor 40 is of a variable type operable to regulate the rotational speed of the dispenser body 38, thereby adjusting a speed (volume) at which the dry ingredients 12 are evacuated downward out of the upper hopper 11 through the discharge port thereof.

A discharge chute 41 covering the dispenser body 38 is fixedly secured to the upper hopper 11 at the lower end thereof. The discharge chute 41 is operable to supply the lower hopper 21 with the dry ingredients 12 discharged by the dispenser body 38. Similarly to the upper hopper 11, the discharge chute 41 is made of either the iron or stainless-steel raw material. This structure allows the dry ingredients 12 downwardly discharged by the dispenser 20 from the upper hopper 11 through the discharge port thereof to be thrown downward into the rear of the lower hopper 21 through the discharge chute 41, the lower hopper 21 being positioned below the discharge chute 41 .

Figure 4:
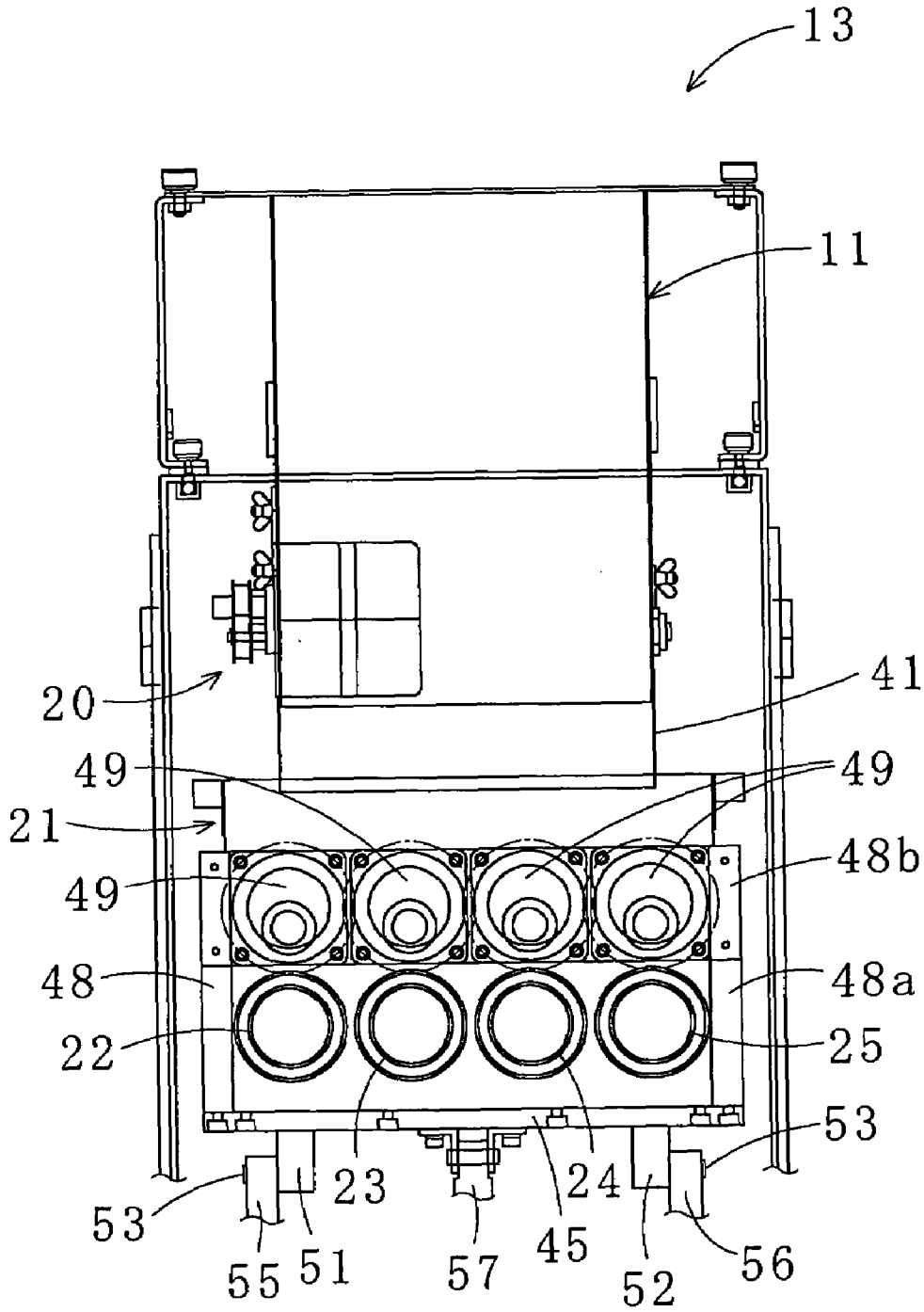
FIG. 4 is a cross-sectional side view illustrating essential components of a weighing mechanism in the device for bagging the dry ingredients.
Figure 5:
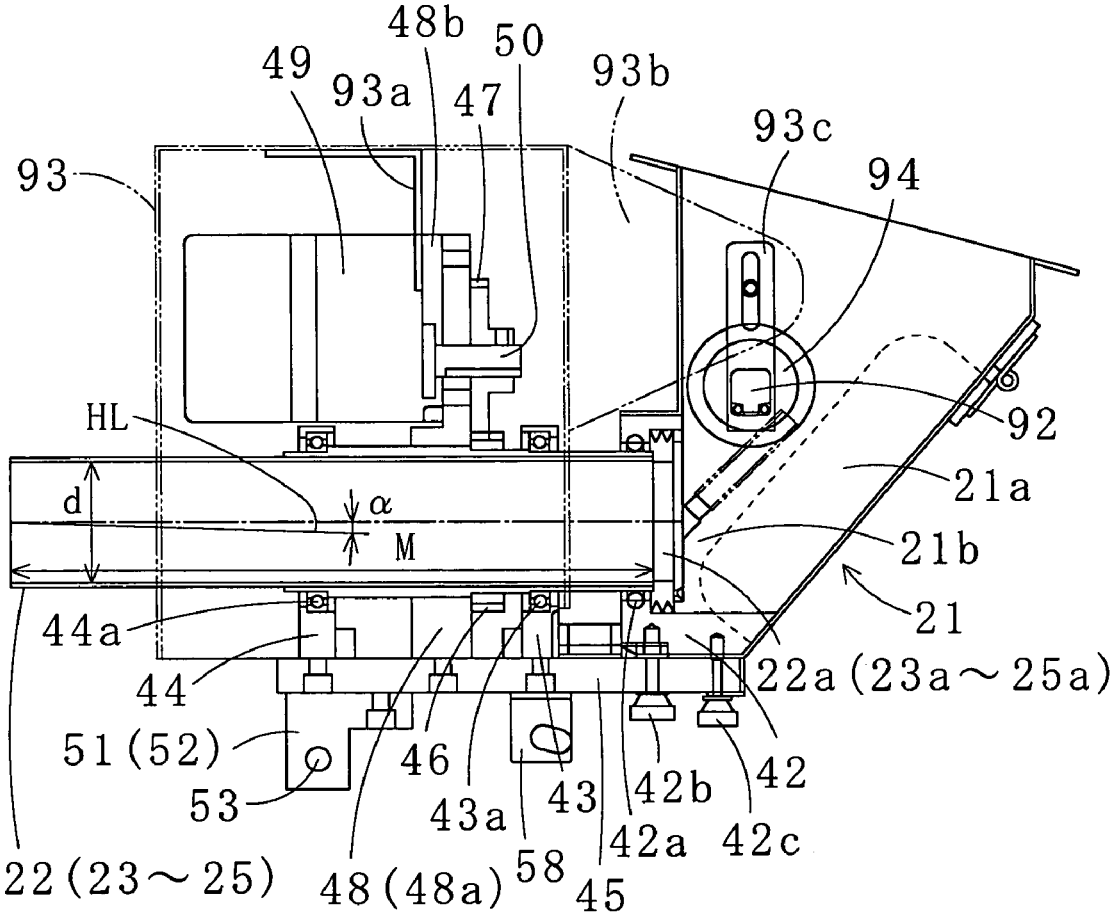
FIG. 5 is a cross-sectional front view illustrating the essential components of the weighing mechanism.

As illustrated in FIGS. 1, 4, and 5, similarly to the upper hopper 11, the lower hopper 21 made wholly of either the iron or stainless-steel raw material is rectangular-shaped when viewed from the top thereof, while having a horizontal cross-section downwardly reduced in size. The lower hopper 21 includes a hinged lid "21*a*" having the bottom slanted, and a discharge portion "21*b*" at the lower end of the lower hopper 21. The lower hopper 21 further includes a level sensor 92 that is operable to deactivate the dispenser 20 to stop dispensing the dry ingredients 12 from the upper hopper 11 when the level of the dry ingredients 12 in the lower hopper 21 reaches a certain amount, but that is operable to activate the dispenser 20 while the level of the dry ingredients 12 is less than a level at which the level sensor 92 is operated.

As illustrated in FIGS. 4 and 5, the discharge portion "21*b*" of the lower hopper 21 is in sealed communication with supply ports "22*a*"–"25*a*" of the four dispensing pipes 22–25. A rectangular-shaped, thick plate-like support member 45 is substantially horizontally provided on the lower hopper 21 at the bottom thereof. Bearing housings 42–44 spaced apart from each other by predetermined space intervals in a longitudinal direction of each of the dispensing pips 22–25 are disposed on the support member 45. Three bearings "42*a*", "43*a*", "44*a*" are provided on the bearing housings 42–44, respectively. The dispensing pipes 22–25 are rotatably disposed through the bearings "42*a*", "43*a*", and "44*a*". A removable rotating blade (not shown) is provided upstream from the dispensing pipes 22–25. The rotating blade is operable to introduce the dry ingredients 12 lodged in the lower hopper 21 at the discharge portion "21*b*" into the dispensing pipes 22–25, and further to destroy the dry ingredients 12 bridged in the lower hopper 21. The bearing housing 42, mounted on the lower hopper 21 around the discharge portion "21*b*", is anchored to the support member 45 at the rear thereof by a mounting screw "42*b*". The distal end of the hinged lid "21*a*" is fixedly secured to the support member 45 at the rear thereof by a mounting screw "42*c*" to open the lid "21*a*" for maintenance or cleaning.

A tire-like, large gear 46 is fixedly secured on each of the dispensing pipes 22–25 at an intermediate position thereof in the longitudinal (anteroposterior) direction thereof. A pair of transversely spaced-apart, upright motor-mounting blocks 48, 48*a* is mounted on the support member 45 near the large gears 46. A rectangular plate-like, flange-mounting plate "48b" is mounted on the top of the pair of the motor-mounting blocks 48, 48*a* by screw mechanisms. Decelerator-equipped, electric motors 49 are mounted on the flange-mounting plates "48*b*". A small gear 47, secured to an output shaft 50 of each of the motors 49, is engaged with corresponding one of the large gears 46. The electric motor 49 is operable to adjust its rotational speed in a non-stepped manner.

The above structure allows the decelerator-equipped electric motors 49 to be driven to revolve the dispensing pipes 22–25, thereby stirring the dry ingredients 12 that stay in the discharge portion "21*b*" of the lower hopper 21 in the course of the dispensing pipes 22–25, conveying the dry ingredients 12 forward in stages in the dispensing pipes 22–25. The dispensing pipes 22–25 can separately be rotated and locked against rotation. To dispense the dry ingredients 12 accurately at high speed, the dispensing pipes 22–25 are controlled to revolve at high speed (100–150 rpm) before 90% of a target weight to be weighed is reached, but to rotate at low speed (10–15 rpm) when 90% of the target weight is reached. To uniformly stream the dry ingredients 12 in the dispensing pipes 22–25, each of the dispensing pipes 22–25 is configured to have length "M", which is four-six times as large as inner diameter "d" of each of the dispensing pipes 22–25.

As illustrated in FIGS. 1, 4, and 5, a pair of spaced-apart, L-shaped mounting brackets 51, 52 is mounted on the support member 45 (which is rectangular-shaped when viewed from the top thereof) at the forward end of the support member 45. The pair of mounting brackets 51, 52 is positioned on the underside of the support member 45 at both sides thereof in the sideward direction thereof. The brackets 51, 52 are supported on support uprights 55, 56 through pins 53, respectively. The support uprights 55, 56 rest on a support member 54 that is horizontally positioned over a common support member 63. A vertically telescopic, extensible member 57 is mounted on the support member 45 at the rear thereof through a mounting bracket 58. The extensible member 57 is positioned on the underside of the support member 45 at the center thereof in the sideward direction thereof. The above structure allows the extensible member 57 to be extended and retracted to adjust a gradient angle $\alpha$ of each of the dispensing pipes 22–25 via the support member 45. The dispensing pipes 22–25 communicated with the lower hopper 21 are inclined at gradient angle $\alpha$ in a direction in which the dry ingredients 12 are dispensed by the dispensing pipes 22–25. The gradient angle $\alpha$ is, e.g., 0° or otherwise any degree greater than 0° but equal or less than 20°. The adjustment of the gradient angle $\alpha$ allows the dry ingredients 12 to be conveyed in controllable amounts in accordance with conditions such as the tendency of the dry ingredients 12 and an amount of the dry ingredients 12 to be processed. In FIG. 5, the character "HL" denotes a horizontal line.

As illustrated in FIGS. 1 and 2, the weighing buckets 27–30 are respectively provided below the forward ends of the dispensing pipes 22–25 in the downstream direction of the dispensing pipes 22–25 for receiving the dry ingredients 12 dispensed from the dispensing pipes 22–25 through the discharge ports "22*b*"–"25*b*". Each of the open/close dampers 26 is provided on corresponding one of the weighing buckets 27–30 at the lower front thereof for temporarily reserving the dry ingredients 12 in corresponding one of the weighing buckets 27–30, and for discharging them into the dispensing chute 31 below the dampers 26. As shown in detail in FIG. 6, an on-off state of a rotary solenoid 59 on a support member (not shown) pivots a pivotal lever "59*a*" mounted on a pivotal shaft of the solenoid 59, thereby pivoting an operating arm "59*b*" mounted on each of the dampers 26 at an upper portion thereof about a pin "59*c*". In this way, the open/close dampers 26 are driven to open and close.

Figure 6:
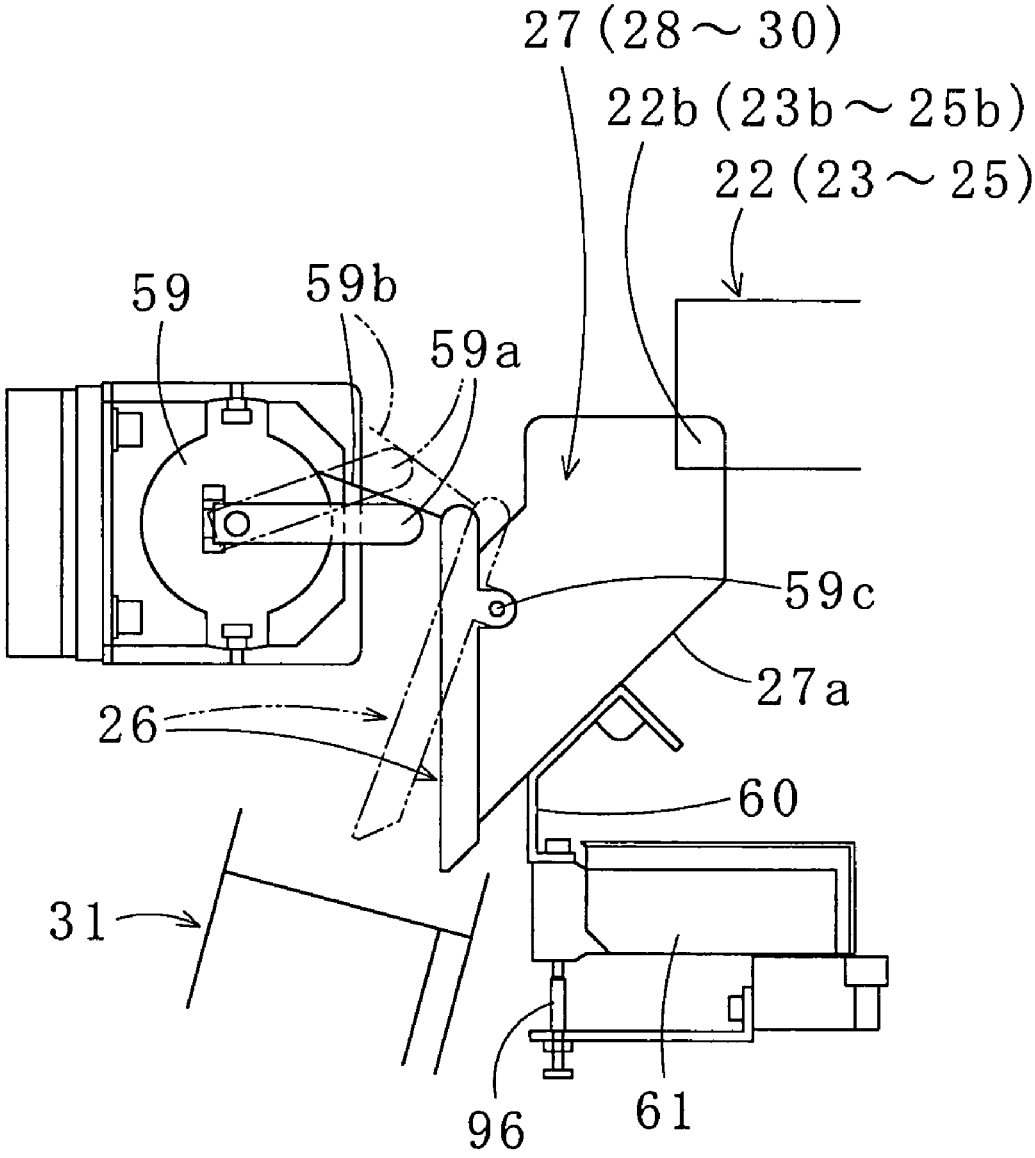
FIG. 6 is an enlarged, cross-sectional front view illustrating the weighing mechanism.

As illustrated in FIG. 1, each of the weighing buckets 27–30 is pivoted about a pin (not shown) provided at the top thereof. A horizontally cantilevered load cell 61 is attached to the slanted bottom "27*a*" of each of the weighing buckets 27–30 via a support member 60. A distal end of the support member 60 horizontally compresses the load cell 61 toward the rear thereof in response to the quantity of the dry ingredients 12 lodged in the weighing buckets 27–30, and such a compression force realizes accurate weighing. To weigh the dry ingredients 12 using the load cell 61, forces formed only by the tare weight (self-weight) of the weighing buckets 27–30 and the weight of the dry ingredients 12 are applied to the load cell 61; however, the weight of the closed damper 26 is not applied to the load cell 61. To achieve accurate weighing using the load cell 61, the support member 54 is positioned on a thick plate-like, common support member 63 via vibration-proof rubber pieces 62. In FIG. 6, reference numeral 96 denotes a threaded stopper. The threaded stopper 96 is screw-loosen, and is thereby lowered in position when the threaded stopper 96 is used.

As illustrated in FIGS. 1 and 2, the dispensing chute 31 is provided beneath the bottommost ends of the weighing buckets 27–30 to allow the dry ingredients 12 separately evacuated from the weighing buckets 27–30 through the discharge ports thereof to be introduced into the small bag-forming unit 15. The dispensing chute 31, in the form of an inverted triangle when viewed from the front thereof, has a discharge port formed at the bottom of the dispensing chute 31. A rotary solenoid 64 and an open/close damper 65 are provided on the dispensing chute 31 at the front thereof. The rotary solenoid 64 is similar to the rotary solenoid 59 used to drive the open/close damper 26. The rotary solenoid 64 drives the open/close damper 65 to discharge the dry ingredients 12 temporarily stored in the dispensing chute 31 into the downward positioned, small bag-forming unit 15 through the discharge port of the dispensing chute 31. A pivotal lever is mounted on a pivotal shaft of the rotary solenoid 64. An operating arm is mounted on the open/close damper 65. The pivotal lever pivots the operating arm about a pin.

The following discusses details of the packaging mechanism 16 with reference to FIGS. 1–3.

The unreeling roller 32 is rotatably supported at both ends on a pair of plate-like support arms 66, 67 with U-shaped grooves 68 on the tops of the support arms 66, 67. The support arms 66, 67 are spaced-apart in a sideward direction of the packaging mechanism, and are disposed on a support member (not shown) that rests on the common frame 18. A rubber tire portion is provided on the unreeling roller 32 at a central portion thereof. The packaging material 14 is wound around the rubber tire portion (not shown). The packaging material 14 looped around the unreeling roller 32 is conveyed intermittently to the downward positioned, packaging material-folding unit 35 when the small bag-conveying unit 37 feeds the small bags "P's" (each of which has three-way edges sealed) and small bag "k" (which has two-way edges sealed) intermittently downward by the distance of one pitch.

The driving force from the small bag-conveying unit 37 releases the packaging material 14 from the unreeling roller 32 in stages. As illustrated in FIG. 3, the packaging material-folding unit 35 (detailed drawings thereof are herein omitted), which includes a guide roller 91, and which is provided between the pair of support arms 66, 67, folds the released packaging material 14 into two equal parts in such a manner that the inner surfaces 33, 34 are overlaid with one another along the centerline "m" which is the center of the transverse (sideward) direction of the packaging material 14. The folded packaging material 14 is guided into the small bag-forming unit 15.

In the small bag-forming unit 15, the packaging material 14 thus folded is heated and sandwiched between a pair of sealing clamps 69, 70 that are brought into and out of contact with one another in the sideward direction of the small bag-forming unit 15. As illustrated in FIG. 3, the result is that the packaging material 14 is longitudinally sealed along the open sideward edge 36 thereof by the distance of one pitch, and at the same time, the packaging material 14 at a lower end of the longitudinally sealed open sideward edge 36 is transversely sealed, thereby forming each transversely sealed portion 71. The sealing clamps 69, 70, each of which has a groove-shaped cross-section, have heating wires (not shown) embedded therein. The embedded heating wires heat each contact surface of the sealing clamps 69, 70 to a predetermined temperature at which the packaging material 14 can be sealed. The pair of sealing clamps 69, 70 is brought into and out of contact with one another by the rotation of a vertical driving shaft 75 (an output shaft) of a decelerator 74. The decelerator 74 is driven by an electric motor 72 through a chain 73. The electric motor 72 is disposed on the common frame 18.

The small bag-conveying unit 37 includes a pair of feeding rollers 76, 77 that are operable to sandwich the longitudinally sealed open sideward edge 36 of each of the small bags "P's" therebetween upon the separation of the pair of sealing clamps 69, 70 from one another, thereby moving the small bags "P's" and "k" downward by the distance of one pitch. A power-distributing mechanism 81 synchronizes the pair of feeding rollers 76, 77 with a horizontal driving shaft 80, thereby reversely rotating the pair of feeding rollers 76, 77. The horizontal driving shaft 80 is rotated by an electric motor 79 provided on a support member 78. The electric motor 79 employs a stepping motor.

The small bag-separating unit 82 (a rotary cutter type) is provided under the small bag-conveying unit 37. The small bag-separating unit 82 is operable to cut the seamless series of small bags "P's" fed from the small bag-conveying unit 37 transversely along the each of the transversely sealed portions 71, thereby providing single pieces or series of a predetermined number of small bags "P's". The small bag-separating unit 82 is provided with a cutter position-adjusting mechanism 83 operable to adjust a vertical distance between the small bag-separating unit 82 and the feeding rollers 76, 77 in accordance with length "L" of each of the small bags "P's". (See FIG. 3.) The cutter position-adjusting mechanism 83 includes a pair of cutter bodies "82*a*", "82*b*", an elevating block 84 having a female thread vertically formed at the rightward end thereof, a vertically positioned, handle-equipped rotating shaft 85 formed with a male thread to be engaged with the female thread formed in the elevating block 84, and a pair of bearings 86, 87 operable to rotatably support the rotating shaft 85 at upper and lower ends thereof, respectively. As illustrated in FIG. 1, a bevel gear mechanism 88 and a ball joint "88*a*" are provided on the vertical driving shaft 75 at a lower portion thereof. The ball joint "88*a*" is operable to drive the cutter bodies "82*a*", "82*b*" into rotation, and is possible to follow the elevation of the elevating block 84. The bevel gear mechanism 88 permits the elevating cutter bodies "82*a*", "82*b*" to be driven in response to the abutment and separation between the sealing clamps 69, 70 of the small bag-forming unit 15.

A belt conveyor 89 is provided above the common frame 18 below the cutter bodies "82*a*, "82*b*" of the small bag-separating unit 82. The belt conveyor 89, slightly slanted upward in the downstream direction thereof, is operable to convey the separated small bags "P's" to the next process.

In FIG. 2, reference numeral 90 denotes an integrated control panel disposed on a support member (not shown) on the common frame 18. The weighing mechanism 13 and the packaging mechanism 16 are disposed as one-piece on the common frame 18. In the integrated control panel 90, a control panel of the weighing mechanism 13 is combined integrally with that of the packaging mechanism 16. The common frame 18 has several casters (not shown) mounted thereon, and the bagging device 10 can manually be pushed to move to given locations, but can be unmovable at certain locations. As illustrated in FIGS. 1, 2, 4, and 5, removable, plate-like covers are mounted on the bagging device 10 at each necessary position in light of hygiene and safety.

Referring to FIG. 5, reference numerals 93, 93*a*, 93*b*, 93*c*, and 94 denote a motor cover, a L-shaped, cover-mounting bracket, a pair of substantially triangular-shaped brackets, a sensor-mounting bracket, and a level sensor window, respectively. The L-shaped, cover-mounting bracket "93*a*" is provided on the flange-mounting plate "48*b*". The pair of substantially triangular-shaped brackets "93*b*", made of a plate material, is disposed on the motor cover 93 at the rear end thereof in the transverse direction thereof. The sensor-mounting bracket "93*c*" is positioned on the pair of brackets "93*b*". The level sensor window 94 is made of a transparent material. In FIG. 1, reference numeral 95 denotes a level sensor operable to detect the level of the dry ingredients 12 in the upper hopper 11.

The following discusses empirical examples of the device 10 for bagging dry ingredients according to the present embodiment.

The experiments are conducted under preconditions that follow:

The dry ingredients 12 are condiments to be added to packed ramen. The small bag "P" (see FIG. 3) is 40–150 mm long (L) and 40–100 mm wide (W). The dry ingredients 12 in the small bag "P" are 0.1–100 g in weight. In the small bag "P", the sealed open sideward edge 36 is 5–15 mm wide (t); the transversely sealed portion 71 is 5–20 mm wide (T). The packaging material 14 is some 90–210 mm wide. A hundred and fifty pieces of the small bags "P's" at maximum can be produced per minute. In this instance, to weigh the dry ingredients 12 in each of the four dispensing pipes 22–25 requires 1.6 seconds at minimum.

The bagging device 10 designed in accordance with the above preconditions is, by way of illustration, 1500–2000 mm high (H), 1000–1500 mm long (N), and 700–1000 mm wide (S). Each of the dispensing pipes 22–25 is 30–100 mm in inner diameter (d), 150–300 mm in length (M), 5–30 rpm at low speed, 60–150 rpm at high speed, and has gradient angle a of either 0° or any other angle greater than 0° but equal or less than 20°. However, the present invention is not limited to the above, and numerals may be changed without departing from the gist of the present invention.

The following discusses the ways of packing and weighing the dry ingredients 12, cutting the sealed small bags "P's" into single pieces, and delivering them to the next process in the bagging device 10, and further discusses beneficial effects resulting therefrom.

(1) The dry ingredients 12 in predetermined amounts are put into the upper hopper 11, and the packaging material 14 is set to be wound around the unreeling roller 32 before the bagging device 10 is run.

(2) The packaging material 14 is folded by the packaging material-folding unit 35 to allow the inner surfaces 33, 34 of the packaging material 14 to be overlaid with one another. The folded packaging material 14 is set between the sealing clamps 69, 70 (the small bag-forming unit 15), the feeding rollers 76, 77 (the small bag-conveying unit 37), and the pair of cutter bodies "82*a*", "82*b*" (the small bag-separating unit 82).

(3) The dispenser unit 20 is driven to dispense the dry ingredients 12 from the upper hopper 11, thereby discharging the dry ingredients 12 into the lower hopper 21 through the discharge chute 41. When the dry ingredients 12 in predetermined amounts are put into the lower hopper 21, then the level sensor 92 detects the dry ingredients 12, and the dispenser unit 20 is stopped.

(4) Each of the dispensing pipes 22–25 is rotated at first rapidly, but at last slowly to put the dry ingredients 12 in predetermined amounts into corresponding one of the weighing buckets 27–30.

(5) The load cells 61 detect the amounts of the dry ingredients 12 put in the weighing buckets 27–30, and the dispensing pipes 22–25 are stopped against rotation individually when the weighing buckets 27–30 are filled with the dry ingredients 12 in predetermined amounts.

(6) When the dispensing chute 31 emits a signal to start dispensing the dry ingredients 12 (i.e., when the emitted signal indicates that the dispensing chute 31 is vacant), then the open/close damper 26 of any one of the previously sequenced weighing buckets 27–30 is opened to evacuate the dry ingredients 12 in predetermined amounts from that particular one of the weighing buckets 27–30 into the dispensing chute 31. As a result, the dry ingredients 12 are temporarily stored in the dispensing chute 31.

(7) When the packaging mechanism 16 emits a signal to start packaging the dry ingredients 12 (i.e., when the emitted signal indicates that conditions operable to charge them into small bags "k" are met), the open/close damper 65 of the dispensing chute 31 is opened. As a result, the dry ingredients 12 temporarily stored in the dispensing chute 31 after the storage in the weighing buckets, are charged sequentially into the small bag "k" (see FIG. 3) in the small bag-forming unit 15.

(8) Each of the open/close dampers 26 closes corresponding one of the weighing buckets 27–30, which is empty after the dry ingredients 12 are dispensed therefrom, and corresponding one of the dispensing pipes 22–25 is rotated to dispense the dry ingredients 12 in predetermined amounts into corresponding one of the weighing buckets 27–30.

(9) In the small bag-forming unit 15, the pair of sealing clamps 69, 70 forms the transversely sealed portion 71 on the small bag "k" along the top thereof. As a result, the small bag "P", which has three-way edges sealed, is formed. At the same time, the small bag "k", which is connected to the small bag "P" along the top thereof, is formed. The small bag "k" has two-way edges sealed, i.e., the lower edge of the small bag "k" and the open sideward edge 36 thereof are sealed.

(10) In the small bag-conveying unit 37, the pair of feeding rollers 76, 77 sandwiches the small bags "P's" along each of the sealed open sideward edges 36 thereof to feed them downward by the distance of one pitch. Thereafter, a signal is emitted to the dispensing chute 31 to start packaging the dry ingredients 12.

(11) In the small bag-separating unit 82, the continuous series of small bags "P's" fed downward by the distance of one pitch from the small bag-conveying unit 37 are cut off from each other along each of the transversely sealed portions 71.

(12) The separated single pieces of small bags "P's" drop down onto the belt conveyor 89, and are conveyed to the next process.

(13) The above steps (6)–(12) are repeated predetermined number of times.

The bagging device 10 employs the slanted, rotating dispensing pipes 22–25, and consequently substantially no vibration occurs, when compared with prior art vibrating feeders. As a result, the dry ingredients 12 in small amounts (e.g., 0.3 g) can be dispensed accurately. In addition, since the four dispensing pipes 22–25 are used, the dry ingredients 12 can be dispensed at high speed. The four dispensing pipes 22–25 can be disposed in a space-saving manner. Since substantially no vibration adversely affects the dry ingredients 12, they remain intact without cracks or chips. The downsized bagging device 10 is achievable when compared with the prior art bagging apparatuses, and can be positioned in small spaces.

Since each of the weighing buckets 27–30 is disposed on corresponding one of the dispensing pipes 22–25, the dispensed dry ingredients 12 can be weighed at high speed. Although the four dispensing pipes 22–25 are employed, the present embodiment is not limited thereto. Alternatively, two, three, or five or greater dispensing pipes may be used when necessary.

Although the open/close damper 65 is disposed on the dispensing chute 31 to temporarily reserve the dry ingredients 12 therein before discharging them into the small bag-forming unit 15, the present embodiment is not limited thereto. Alternatively, the open/close damper may be deleted when such a deletion brings about no troubles with time schedules, and consequently the dry ingredients 12 may be discharged from the weighing buckets 27–30 directly into the small bag-forming unit 15.

The upper and lower hoppers 11, 21 sandwiching the discharge chute 41 therebetween are provided. The upper hopper 11 is used as a vessel for the supply of the dry ingredients 12 to the lower hopper 21. The lower hopper 21 is used as a vessel for holding only a required amount of the dry ingredients 12 among the dry ingredients 12 ejected from the upper hopper 11. The use of such separated functions avoids head-caused great pressures applied to the dry ingredients 12 in the lower hopper 21 before they are introduced into the dispensing pipes 22–25. As a result, the dispensing pipes 22–25 can stably dispense the dry ingredients 12. Alternatively, the upper and lower hoppers may be replaced by a single hopper when no great pressures are applied to the dry ingredients 12 or otherwise when the self-weight of the dry ingredients 12 is of little influence.

To introduce the lodged dry ingredients 12 in the discharge portion "21*b*" of the lower hopper 21 into the dispensing pipes 22–25, the removable rotating blade is provided. The rotating blade is replaceable for wear and cleaning. Alternatively, the rotating blade may be deleted when the replacement of it due to the wear or cleaning is not required.

Although the packaging mechanism 16 including the upright, three-way sealing type of small bag-forming unit 15 is provided, the present embodiment is not limited thereto. Alternatively, a packaging mechanism including a non-upright sealing type (e.g., a rotary type) of small bag-forming unit may be provided when necessary.

Although the small bag-separating unit 82 and the belt conveyor 89 are disposed on the common frame 18, the present embodiment is not limited thereto. Alternatively, the small bag-separating unit and the belt conveyor may be deleted when situations allow.

Although gradient angles $\alpha$'s of the dispensing pipes 22–25 can be adjusted concurrently, the present embodiment is not limited thereto. Alternatively, gradient angles $\alpha$'s may be adjusted individually, when needed. As a further alternative, a fixed gradient angle $\alpha$ may be used, if needed.

INDUSTRIAL APPLICABILITY

As described above, in the device for bagging dry ingredients according to the present invention, the weighing mechanism includes the plurality of rotating dispensing pipes, not a plurality of vibrating feeders, and consequently can easily be integrated with the packaging mechanism on the common frame. This feature provides a common mechanical unit sharable by the weighing and packaging mechanisms, a simplified control unit, and the downsized device for bagging dry ingredients.

The device for bagging dry ingredients according to the present invention includes the plurality of juxtaposed dispensing pipes and the plurality of juxtaposed weighing buckets. This construction is adapted to dispense and weigh the dry ingredients in small amounts sequentially with accuracy at high speed in order to package them. The dry ingredients include, e.g., toppings to put on cooked rice with hot green tea poured thereon, various fish and vegetable flakes to sprinkle on cooked rice, or condiments in packed ramen.

In the device for bagging dry ingredients according to the present invention, the small bag-forming unit charges the dispensed dry ingredients from the weighing mechanism into the top-open, small bag, and transversely seals the preceding dry ingredient-charged small bag along the top thereof In the small bag-separating unit lower in position than the small bag-forming unit, the dry ingredient-packed small bags, each of which has three-way edges sealed, are transversely cut off from each other in sequence along the transversely sealed portions thereof. At these steps, the formation of the small bags, the loading of the dry ingredients into the small bags, and the transverse cutting of the small bags are practiced in a shorter time. This feature provides improved productivity.

In the device for bagging dry ingredients according to the present invention, the dispensing chute is located immediately above the small bag-forming unit. This construction allows the dry ingredients to be put into the top-open, small bag promptly from the dispensing chute. As a result, the dry ingredients can be charged into the small bag in a reduced time.

In the device for bagging dry ingredients according to the present invention, the hopper is divided into the upper and lower hoppers. This construction avoids great pressures applied to the dry ingredients in the lower hopper before they are introduced into the dispensing pipes, and consequently the dispensing pipes are possible to stably dispense the dry ingredients. As a result, the high-speed weighing of the dry ingredients as well as the stable dispensing of the dry ingredients is achievable.

In the device for bagging dry ingredients according to the present invention, the gradient angles of the plurality of dispensing pipes can be simultaneously adjustable. This structure eliminates the need to regulate the dispensing pipes individually, and consequently provides easy adjustment as well as a reduced adjustment time.

The invention claimed is:

1. A device for bagging dry ingredients, comprising:

a weighing mechanism operable to dispense and weigh stored dry ingredients; and, a packaging mechanism operable to allow the dry ingredients in predetermined amounts sequentially dispensed by the weighing mechanism to be encapsulated in sequence into small bags, the small bags being formed continuously from a belt-like packaging material having a certain width, wherein the packaging mechanism is disposed integrally with the weighing mechanism on a common frame, wherein the weighing mechanism comprises:

(1) a hopper operable to store the dry ingredients and to discharge the dry ingredients in steps out of the hopper through a bottom of the hopper;

(2) a plurality of juxtaposed dispensing pipes positioned horizontally or slanted downward in a direction in which the dry ingredients discharged from the hopper are dispensed, the dispensing pipes being driven into independent rotation, thereby dispensing the dry ingredients in steps from the hopper;

(3) weighing buckets positioned downward from the dispensing pipes, the weighing buckets being operable to weigh the dry ingredients to store the dry ingredients in predetermined amounts, each of the weighing buckets being provided with an open/close damper at a lower portion of each of the weighing buckets in order to dispense the dry ingredients temporarily stored in the weighing buckets; and (4) a dispensing chute operable to temporarily store the dry ingredients discharged from the weighing buckets and to supply the packaging mechanism with the dry ingredients through an open/close damper at elevated speed, wherein the packaging mechanism comprises a packaging material-folding unit operable to progressively release the packaging material wound in a roll-shape, and to fold the packaging material into two along a centerline of the packaging material; and a small bag-forming unit operable to fabricate top-open, small bags by permitting the packaging material folded and supplied by the packaging material-folding unit to be longitudinally sealed along an open sideward edge of each of the small bags to be formed, and to be transversely sealed along a lower portion of each of the small bags to be formed, while simultaneously such transverse sealing allows each of the small bags already charged with the dry ingredients to be encapsulated along a top thereof, and wherein the dry ingredients in predetermined amounts stored in the weighing buckets are discharged from the weighing buckets into the dispensing chute through the open/close dampers of the weighing buckets, and further, the dry ingredients in the dispensing chute are fed in sequence into the top-open small bags formed in the small bag-forming unit through the open/close damper of the dispensing chute, the small bag-forming unit being located beneath the dispensing chute.

2. A device for bagging dry ingredients as defined in claim 1, wherein the packaging mechanism further comprises:

a small bag-conveying unit located downward from the small bag-forming unit for intermittently conveying the small bags downward; and a small bag-separating unit disposed downward from the small bag-conveying unit for allowing the small bags packed with the dry ingredients to be transversely cut off from each other in sequence along each position at which each of the small bags has transversely been sealed.

3. A device for bagging dry ingredients as defined in claim 2, wherein the hopper comprises an upper hopper and a lower hopper located below the upper hopper, and a rotating dispenser is provided on the upper hopper at a lower discharge portion of the upper hopper in order to feed the dry ingredients in steps from the upper hopper into the lower hopper through the dispenser.

4. A device for bagging dry ingredients as defined in claim 3, wherein the plurality of dispensing pipes are disposed on a common support member, and gradient angles of the plurality of dispensing pipes are simultaneously adjustable.

5. A device for bagging dry ingredients as defined in claim 2, wherein the plurality of dispensing pipes are disposed on a common support member, and gradient angles of the plurality of dispensing pipes are simultaneously adjustable.

6. A device for bagging dry ingredients as defined in claim 1, wherein the hopper comprises an upper hopper and a lower hopper located below the upper hopper, and a rotating dispenser is provided on the upper hopper at a lower discharge portion of the upper hopper in order to feed the dry ingredients in steps from the upper hopper into the lower hopper through the dispenser.

7. A device for bagging dry ingredients as defined in claim 6, wherein the plurality of dispensing pipes are disposed on a common support member, and gradient angles of the plurality of dispensing pipes are simultaneously adjustable.

8. A device for bagging dry ingredients as defined in claim 1, wherein the plurality of dispensing pipes are disposed on a common support member, and gradient angles of the plurality of dispensing pipes are simultaneously adjustable.

* * * * *